US006698160B2

(12) United States Patent
Peronek et al.

(10) Patent No.: US 6,698,160 B2
(45) Date of Patent: Mar. 2, 2004

(54) APPARATUS AND METHOD TO PREVENT BOTTLE ROTATION

(75) Inventors: Michael H. Peronek, Brunswick, OH (US); Kevin Sweeny, Columbia Station, OH (US)

(73) Assignee: FCI, Inc., Cleveland, OH (US)

( * ) Notice: Subject to any disclaimer, the term of this patent is extended or adjusted under 35 U.S.C. 154(b) by 55 days.

(21) Appl. No.: 10/078,973

(22) Filed: Feb. 19, 2002

(65) Prior Publication Data

US 2003/0154694 A1 Aug. 21, 2003

(51) Int. Cl.[7] ..... B65B 7/28
(52) U.S. Cl. ..... 53/317; 53/331.5
(58) Field of Search ..... 53/317, 331.5, 53/367, 368, 369

(56) References Cited

U.S. PATENT DOCUMENTS

| | | | | | |
|---|---|---|---|---|---|
| 1,055,796 | A | | 3/1913 | Recht | |
| 1,912,677 | A | | 6/1933 | Williams | |
| 2,106,464 | A | | 1/1938 | Meyer | |
| D181,718 | S | | 12/1957 | DuPree | |
| D182,882 | S | | 5/1958 | DePree | |
| 2,987,313 | A | | 6/1961 | Bjering et al. | |
| D192,942 | S | | 5/1962 | DePree | |
| 3,075,331 | A | * | 1/1963 | Stanley | 53/353 |
| 3,262,247 | A | | 7/1966 | Scholle | |
| 3,432,989 | A | | 3/1969 | Bouzereau | |
| 3,461,649 | A | * | 8/1969 | Ermer, Jr. et al. | 53/201 |
| 3,499,567 | A | | 3/1970 | Spotts | |
| 3,771,284 | A | | 11/1973 | Boeckmann et al. | |
| 3,805,488 | A | | 4/1974 | Holstein | |
| 3,812,646 | A | | 5/1974 | Baldyga et al. | |
| 3,831,344 | A | | 8/1974 | Over | |
| 3,875,725 | A | | 4/1975 | Carmichael | |
| 3,946,540 | A | * | 3/1976 | Solberg et al. | 53/341 |
| 4,098,059 | A | | 7/1978 | Chattillion | |
| 4,114,347 | A | | 9/1978 | Morris et al. | |
| 4,120,135 | A | | 10/1978 | Baldyga | |
| 4,143,754 | A | | 3/1979 | Eldred | |
| 4,280,612 | A | | 7/1981 | Nagano | |
| 4,295,320 | A | | 10/1981 | Willingham | |
| D272,521 | S | | 2/1984 | Glenn | |
| 4,559,760 | A | * | 12/1985 | Daniels et al. | 53/314 |
| 4,624,098 | A | | 11/1986 | Trendel | |
| 4,663,913 | A | | 5/1987 | Trendel | |
| 4,765,119 | A | | 8/1988 | Aidlin et al. | |
| 4,793,120 | A | * | 12/1988 | Herzog | 53/331.5 |
| 4,817,363 | A | | 4/1989 | St. Clair | |
| 4,905,447 | A | * | 3/1990 | Margaria | 53/317 |
| 4,930,288 | A | * | 6/1990 | Juenkersfeld | 53/329.3 |
| 4,939,890 | A | | 7/1990 | Peronek et al. | |
| 4,950,350 | A | | 8/1990 | Zodrow et al. | |
| 4,978,015 | A | | 12/1990 | Walker | |
| 5,123,227 | A | * | 6/1992 | Shibauchi et al. | 53/201 |
| 5,217,737 | A | | 6/1993 | Gygax et al. | |
| 5,220,767 | A | * | 6/1993 | de Santana | 53/331.5 |
| 5,224,586 | A | | 7/1993 | Naka et al. | |
| 5,398,485 | A | * | 3/1995 | Osifchin | 53/490 |
| 5,408,801 | A | * | 4/1995 | Molinaro | 53/300 |
| 5,423,159 | A | * | 6/1995 | Bankuty et al. | 53/317 |
| 5,457,936 | A | | 10/1995 | Neel | |
| 5,542,233 | A | * | 8/1996 | Graffin | 53/282 |

(List continued on next page.)

*Primary Examiner*—Eugene L Kim
(74) *Attorney, Agent, or Firm*—Fay, Sharpe, Fagan, Minnich & McKee

(57) ABSTRACT

A bottle support plate for use in a rotary capping machine used to apply caps onto the upper threaded neck of one or more containers having a non-fully circular flange. The containers are moved along a generally circular path by a star wheel. The bottle support plate is connected to the star wheel and includes a pocket that at least partially supports and at least partially mates with the flange of the container to at least partially inhibit rotation of the container during the threading of a cap on the upper threaded neck of the container.

50 Claims, 5 Drawing Sheets

U.S. PATENT DOCUMENTS 5,581,975 A 12/1996 Trebbi et al.
D377,603 S 1/1997 Smith
5,603,423 A 2/1997 Lynn et al.
5,732,528 A 3/1998 Peronek et al.
5,816,029 A 10/1998 Sweeny
5,826,400 A 10/1998 Martin et al.
5,913,438 A 6/1999 Beck et al.
5,934,042 A 8/1999 Peronek
5,989,661 A 11/1999 Krishnakumar et al.
5,996,796 A 12/1999 Kvitrud et al.
6,276,546 B1 8/2001 Davis et al.

* cited by examiner

APPARATUS AND METHOD TO PREVENT BOTTLE ROTATION

The present invention relates to the art of capping containers as they are moved along a preselected path, and more particularly to an improvement in a capping machine which prevents rotation of the container as a cap is being tightened onto the neck of the container. The invention is particularly applicable to a container guide which retains the container in the filling and/or capping machine as the container passes through the machine and will be described with particular reference thereto.

BACKGROUND OF THE INVENTION

Machines in the bottling industry for filling containers or capping containers after being filled are well known in the prior art. As defined herein, such machines are collectively referred to as bottling machines. Reference may be had to U.S. Pat. Nos. 5,934,042; 5,816,029; 5,732,528; 4,939,890; 4,624,098; and 4,295,320 which are incorporated by reference herein for a description of applications for conventional type bottling machines. Such machines will not be described in detail in this specification.

Generally, a capping and/or filling apparatus includes a rotatable star wheel mechanism for moving the containers through the machine. The star wheel generally includes a mechanism for supporting the container which is generally arranged about the periphery of the star wheel. An infeed mechanism or conveyor is utilized to bring the containers to an entry point of the star wheel, and an outfeed mechanism or conveyor is similarly mated to the rotatable star wheel mechanism to transfer the capped (or filled) containers from an exit point of the star wheel. A stationary rear guide c extending generally between the entry and exit points is generally spaced radially outwardly from the neck support assembly on the rotatable star wheel. This rear guide functions to retain the containers in the individual pockets of the neck support assembly as the star wheel rotates. In a conventional capping apparatus, a turret capper head is directly over the capper star wheel and moves in synchronous rotation with the capper star wheel. In a bottle filling apparatus, a filling head is located above the capper star wheel. Either of the capper head or the filling head is driven axially downward at pre-determined periods of time to place a tightened cap onto the container or to place product within the bottle. Each capper head generally employs a clutch mechanism whereby the capper head is rotated and driven axially downward at a predetermined force and torque to tighten the cap on the container.

Within a bottling plant or facility, a single capping or filling machine is used to fill or cap many different sized containers. In the soft drink industry such size container can include a 12-oz bottle, a 20-oz bottle, a 1-liter bottle, a 2-liter bottle, or others. Positive control of the containers throughout the machine is typically maintained by holding the containers by the neck. Thus, based upon a predetermined control height, all the containers will be guided, and/or be partially or fully suspended throughout the filling or capping process by the container neck flange. Normally, the container will be rested on or be suspended above the normal wear surface. Mounted on the basic shaft of the bottling machine is a hub which supports the mounting plate and star wheel thereon. As the shaft is rotated, the hub rotates the star wheel, thus moving the containers through the machine to accomplish the capping and filling process. Smaller star wheels include and neck support assemblies integral with the hub. Larger star wheel assemblies include neck guide assemblies mounted on the star wheel. Each neck guide assembly has fingers extended therefrom and guides and/or supports the neck of the container.

In order to retain the control height for different sized containers, each container requires a different size and/or shape neck support bracket and lower body guide support for the sidewall of the container. Thus, in each instance where the container size to be run is changed, it is necessary to changeover different aspects of the bottling machine including those portions of the machine which are specific to the particular container size being run on the line. In a bottling plant, such a changeover requires the use of skilled labor to remove the equipment which is specific for a particular size container and replace it with substitute equipment which is specific for a different size container. Thousands of containers pass through a bottling machine each hour. Maintaining this volume is very important to meet both consumer and industry demands as well as plant capacity. As such, the down time associated with a changeover to different size containers is a significant loss both in dollars and productivity due to reduced output capacity, idle manpower and the skilled work force required to complete a changeover. In order to address this problem, a modified container guide was developed and is disclosed in U.S. Pat. No. 5,732,528 which is incorporated herein by reference. U.S. Pat. No. 5,732,528 discloses an improved container guide system for a bottling machine, which includes a redesigned star wheel and rear container guides that enable the body guide, or body star, on the star wheel and the sidewall guide on the rear container guide to be capable of quick adjustment without the necessity of removing and reinstalling different guides for different sized bottles. Changeover mainly requires depressing a button on each guide to release an adjustable locking mechanism and to slide the guide along a positioning rod to a desired new position. A positioning block located on the guides holds the adjustable locking mechanism and effectively moves the body guide and/or sidewall guide to its new position where the button is released to lock the guide in place. The easy adjustment also allows for quick and easy removal of the guide and replacement with another guide having the size requirements desired. This improved container guide system significantly reduces the down time of a bottling line due to a changeover. No tools are needed to effect the changeover as it relates to container guides, thus a machine operator is capable of depressing the button for releasing and sliding the body guide, or body star, on the star wheel or the sidewall guide on the rear container guide to a second position where the button is released and the guide is locked into place. The improved guide system also reduces the number of parts necessary to effect a changeover on a bottling line and provides a positive adjustable control guide once the initial modifications to install the invention are made to the bottling machine.

With respect to the cap or the closure, for years, the crown was the dominant closure employed on containers and is still in use today in the beer industry. The crown closure eventually was partially replaced by caps or closures commonly called "roll-on" caps. This type of closure comprised a cap shell of aluminum which was inserted over the threaded neck of the container and then secured in place by rolling threads in situ into the walls of the cap shell. Capper heads which performed the rolling operation typically exerted downward forces of up to 500 pounds onto the neck of the container. This force, of course, was transmitted to the base of the container and threat developed a sufficient frictional force with the capper star wheel base to prevent container rotation during the capping process. Over time, the roll-on cap was partially replaced with plastic or metal locking type, threaded caps. In the beverage industry, threaded safety caps have a frangible connection at the cap base thereof which will herein be referred to as a "lock band". In the case of a metal cap, the capper heads simply crimped the lock band about the container neck portion beneath the lowermost thread. In the case of a plastic cap, heat is applied to the lock band of the cap after the cap is tightened onto the filled container and then shrunk to the neck of the container. Plastic caps with heated lock bands can be applied to either plastic or glass containers. In the plastic cap application, the force of the capper head is generally reduced to a downward thrust of about 50–60 pounds. This force is not sufficient to generate a sufficient frictional force at the base of the container to prevent the container from rotating in the pocket of the capper star wheel. Container rotation in the capper pocket prevented adequate cap tightening. Accordingly, several different concepts have been employed to prevent container rotation for plastic cap applications. For example, the container was shaped with a wedge sidewall configuration and the transfer mechanisms between the various star wheels was modified to feed the containers into configured pockets. Additionally, a high friction material such as polystyrene was applied to the bottom of the container, especially for glass bottles, so as to better grip the base of the capper star wheel and enhance the frictional, anti-rotation force. Such modifications, while functional, were not acceptable. The consuming public did not accept configured containers. Adding friction material to the container materially increased its cost, and its effectiveness was diminished in the event the base of the capper star wheel became wet or was subjected to oil, both of which are common occurrences in the operation of a bottling plant. U.S. Pat. No. 4,624,098, which is incorporated herein by reference, disclosed the use of a belt to urge the container against the rear guide, thus increasing the friction between the side of the container and the rear guide which, when added to the frictional force at the base of the container, helped to prevent container rotation during the tightening of the cap. This capping design has proven acceptable in capping applications where the downward force exerted on the container head from the capping head is as low as 50–60 pounds.

More recently, plastic, threaded safety caps or closures have been developed which do not require the application of heat to set or position the lock band. By tapering the bottle neck beneath the lowermost thread and also tapering the edge of the lock band, the lock band simply snaps in a locking position vis-a-vis the tapered fit when the cap is tightened to a predetermined position. This position occurs when the axial downward force on the cap from the capper head is about 15–20 pounds. This low capper force makes retention of the container within the pocket very difficult, even with the use of very strong elastic bands in the pocket such as disclosed in U.S. Pat. No. 4,624,098. Accordingly, the device now in conventional use for such threaded plastic caps, at least when used on plastic containers, is a anti-rotation device developed by Metal Box p.l.c. This device includes a capper pocket that has an arbitrarily designated forward converging surface and a rearward converging surface. The forward converging surface has backwardly facing teeth which oppose the tightening direction of rotation of the capper head. The rearward converging surface is smooth and acts, in conjunction with rear guide, as a cam surface to drive the container neck against the teeth of the forward converging surface. This device has several limitations. For instance, the toothed anti-rotation device is limited to plastic bottle applications in which the backwardly facing teeth can grip and permanently indent the surface without fracturing the container. In glass bottles, the shock loading when the backwardly facing teeth grip the neck could result in container fracture. Furthermore, although the forward and rearward converging surfaces are designed to be easily replaced, the replacement cost for each capper pocket approaches several hundred dollars and is relatively expensive. In addition, the device is functionally limited. Not all containers have straight neck portions underneath the threads. Many bottle designs curve or taper the neck, and when this occurs, the backwardly facing teeth make detrimental point contact with the container neck. More significantly, the diameter of the neck portions of a plastic container, whether tapered or straight, typically varies from the nominal dimension. The dimensional variation means that for some containers, the neck of the container will be cocked or wrenched into point indentation contact with the backwardly facing teeth as the cap is tightened. This will mark or score the neck wall and such marking is, of course, aggravated if the neck tapers and is not straight. Since the plastic used to manufacture the container is somewhat permeable, the scoring permits the gas of a carbonated beverage within the container to more easily permeate through the plastic, contributing to a "flat" beverage. More critical, though, is that the neck marking or scoring acts as a stress riser to cause an occasional container failure. This is unacceptable. Additionally, the container is aesthetically marred.

These problems were successfully addressed in U.S. Pat. No. 4,939,890, wherein an upwardly directed knife is used to prevent the rotation of the container during the capping process. The knife engaged the lower surface of a circular flange at the bottom of the threaded neck of a plastic container to prevent rotation of the plastic container. A mechanism for externally applying a downward force on the body of the container being capped, which force was independent of the downward force created by the capping operation, was used during the capping process. This anti-spin or anti-rotation mechanism has been successful. The anti-rotation device of U.S. Pat. No. 4,939,890 is the most successful arrangement for applying plastic threaded safety caps onto the top of plastic containers where the caps do not require heat to set or position the lower lock band around the neck of the container.

Although the capping mechanism disclosed in U.S. Pat. No. 4,939,890 addressed many of the past deficiencies of past capping mechanisms, the improved capping mechanism required a mechanism for exerting a downward force on the container which was expensive and was dependent upon certain structural characteristics at the upper portion of the container itself. Changes in container configuration often require a new force-exerting mechanism. In addition, the use of the knife slightly disfigured the plastic containers, thereby making the containers less aesthetically pleasing to the consumer. U.S. Pat. Nos. 5,934,042; 5,826,400; 5,816,029; and 5,398,485 disclose anti-rotation mechanisms that address these issues. These patents disclose an anti-rotation mechanism used on a capping machine, which accomplishes the results of the anti-rotation arrangement disclosed in U.S. Pat. No. 4,939,890, but which does not rely upon developing downward frictional force on the top of the container during the capping operation.

The anti-rotation devices disclosed in U.S. Pat. Nos. 5,934,042; 5,826,400; 5,816,029; and 5,398,485, which are incorporated herein by reference, are particularly applicable for use with a plastic container having a pedaloid base (e.g. base with multiple legs), which is somewhat standard in the soft drink industry. These bases include a plurality of downwardly extending feet or pads, generally four or five, separated by diverging recesses. The plastic containers with pedaloid bases are capped in standard machines having a lower plate rotated with the capping heads and having contoured recesses or nests directly aligned with the capping heads and pockets of the rotating star wheel. A plurality of specially contoured recesses that match the pedaloid base configuration are used to receive the bases of the containers as the containers are moved by the star wheel. Since the containers rest upon the lower circular wear plate or ring and are held within a contoured nest on the plate, rotation of the containers is prevented by an interference between the lower wear plate and the bottom, or base, of the container. This arrangement is completely different from the concept of increasing the friction at the top of the container or otherwise preventing rotation of the container by frictional force.

The provision of a lower circular wear plate with machined recesses, each matching the contour of a pedaloid base of the plastic containers, can be expensive. Each of the contoured recesses must be specially produced and accurately matched with respect to the actual shape of each pedaloid base of the container being processed. Consequently, each container required its own lower support wear plate. Indeed, when the filled containers being capped are changed from a four pad pedaloid base to a five pad pedaloid base, a completely new, specially machined plate for supporting the pedaloid bases must be assembled onto the machine. This arrangement for providing a plate rotatable with the star wheel for supporting the lower pedaloid bases of the container demanded a plate which must be accurately machined for use with specific star wheels. Another anti-rotation system included an arrangement for fixing the support member or wear plate in a position spaced from the turret where the containers slide along a rib as the containers are moved around the arcuate path dictated by the movement of the capping head and the star wheel. The rib extended into the lower recess of the pedaloid base of the individual container to prevent rotation of the container as the capping head drove the cap onto the upper threaded neck of the container. By using this construction, a lower support plate carrying the upstanding rib was fixed and did not rotate with the star wheel. The upwardly extending rib prevented rotation of the container during the capping operation. This use of a fixed rib constituted an improvement over other arrangements for using a lower plate with specially contoured recesses to provide interference against rotation of the container by the capping head; however, it required a modification of the capping machine and was expensive to retrofit.

Two anti-rotation mechanisms that overcome these past problems are disclosed in U.S. Pat. Nos. 5,934,042 and 5,816,029. These anti-rotation mechanisms use a standard wear plate of the type rotating with the star wheel of a rotary capping machine and are adapted to accommodate cylindrical containers with an outer cylindrical periphery and a pedaloid base with spaced pads separated by radial recesses extending from a center recess of the base. In the capping machine, the containers are moved along a circular path by a star wheel that has outwardly protruding pockets supporting the necks of the containers while they are supported at the lower position by a rotating wear plate. The wear plate is a flat ring rotated in unison with the star wheel about the machine axis so the containers moving along a given circular path are carried by and supported on the wear plate. The ring constituting the wear plate has an upwardly facing flat surface with a series of container receiving nests movable along the circular path as the ring is rotated by the turret of the capping machine. Each of these nests has an inner area constituting a flat surface and at least one elongated bar-like abutment projecting upwardly from the flat surface of the ring and extending in a direction radial of the inner area of the nests. In practice, two or three of the elongated bar-like abutments project radially outwardly from the inner area defining the nest onto which a container is supported. These radially projecting abutments are faced by an angle defined as 360°/X, wherein X is a number of pads in the pedaloid base. The rib extends into the lower recess of the pedaloid base of the individual container to prevent rotation of the container as the capping head drives the cap onto the upper threaded neck of the container.

Although these prior art capping mechanisms have had excellent success in the bottling of carbonated beverages, problems with damage to the base of the plastic container have resulted when bottling non-carbonated beverages such as water, fruit drinks and the like. Most of the plastic bottles or containers used in the beverage industry are plastic containers made from blow molded polyethylene terephthalate (PET). These plastic containers include "champagne" type bases or bases having a plurality of feet to structurally enhance the base of the plastic bottle or container. Much of the plastic container design has been directed to the carbonated beverage industry. However, the non-carbonated beverage market such as water, sport drinks, fruit drinks and the like has continued to grow. It is not uncommon that plastic containers originally designed for carbonated beverages are used for non-carbonated beverages. However, the use of these plastic containers has been problematic, especially during the bottling of the non-carbonated beverage. The gas in a carbonated beverage exerts a force on interior of the container, thus resisting the deformation or collapse of the base of the container during the capping process. As a result, the base and walls of the plastic container can be made of a thinner material, which is a significant cost savings to the manufacturer. The absence of gas in non-carbonated beverages has resulted in increased deformation and/or damage of the base of the plastic container during the bottling process. In order to address this problem, increased wall thickness for the side walls and base of the plastic container has been used. Although the increased wall thickness of the plastic container reduces the incidence of deformation and/or damage of the base of the plastic container during the bottling process, the increased wall thickness translates into increase material costs. Alternatively, plastic containers that include a plastic base attachment have also been used to address this problem. However, the use of the plastic base attachment also increases the cost of the container. Bottling manufacturers that bottle both carbonated and non-carbonated beverages must now maintain additional inventory of various bottle or container configurations and thicknesses. In addition, plastic containers that do not have a pedaloid base could not be used in a bottling apparatus that had anti-wear plates to prevent rotation of the container. For instance, containers having flat bases or champagne type bases were not prevented from rotation on such wear plates.

In view of the present state of the art for bottling machines, there is a need for a bottling machine that can be used for non-carbonated beverages which resists deformation and/or damage to the base and/or body of the plastic beverage container during the bottling process, and which can be used to inhibit or prevent rotation of a variety of container designs during the bottling and/or capping process.

SUMMARY OF THE INVENTION

The present invention provides an improved device and/or method for preventing rotation of a container of the type having a body with a flange below a neck on the top of the container. The invention is particularly applicable for use with a container having a generally cylindrical body with a flange below a threaded neck on the top of the container. The invention is particularly applicable to the beverage industry, and more applicable to the non-carbonated beverage industry; however, the invention is equally applicable to the carbonated beverage industry. In addition, the present invention is applicable to the bottling of liquids other than beverages in containers (e.g. food products other than beverages, cleaning products, automotive products, paint products, etc.). In accordance with the present invention, there is provided a bottle support plate that at least partially supports the container at the flange below the neck of the container during the capping process. The bottle support plate is designed to at least partially counter the axially downward force exerted on the container when the capping machine exerts a downward force on the top of the container as the cap is being applied to the container. The counteractive effect of the bottle support plate results in a reduction or elimination of compressive forces exerted on the body and/or base of the container. As a result, damage to the base and/or body of the container is reduced or eliminated during the capping process. The support plate can also or alternatively be designed to at least partially counter the axially downward force exerted on the container when the container is at least partially filled with a fluid. Depending on the flow rate of the fluid into the container, the viscosity of the fluid, and/or the temperature of the fluid, the fluid can cause damage to the base of the container during the filling process. The bottle support plate can reduce or eliminate such damage to the base of the container during the filling process by partially or fully supporting the container such that the base of the container does not bear the full load or force of the fluid during the filling process. The bottle support plate can be made from a number of different materials that are resistant to wear and which can at least partially support the weight of the container during the capping and/or filling process. Such materials include, but are not limited to, metal (e.g. stainless steel, aluminum, etc.), plastics, fiberglass, rubber, etc.

In another aspect of the present invention, the bottle support plate is used to partially or fully support plastic containers; however, other types of containers can be used such as, but not limited to, glass containers, metal containers, and the like. Blow-molded plastic containers for handling liquids at elevated pressures are known and have found increasing acceptance. Such containers are accepted particularly in the beverage industry as disposable containers for use with effervescent or carbonated beverages, especially carbonated soft drinks. These plastic containers can reliably contain carbonated beverages generating internal pressures as high as 100 psi or more, and can be inexpensively manufactured. Typically, these plastic containers have a cylindrical shape which reliably contain carbonated beverage products, can be easily handled, can be inexpensively manufactured, and have stability when filled and unfilled. Such containers have most frequently been manufactured from plastic materials such as polyethylene terephthalate (PET) by, for example, blow molding a portion of PET into a mold formed in the shape of the container. The biaxial expansion of PET by blow molding imparts rigidity and strength to the formed PET material, and blow molded PET can provide economically acceptable wall thicknesses, with clarity in relatively intricate designs, sufficient strength to contain pressures up to 100 psi and more, and resistance to gas passage that may deplete contained beverages of their carbonation. Several of these plastic bottles are disclosed in U.S. Pat. Nos. 4,120,135; 4,978,015; 4,939,890; 5,398,485; 5,603,423; 5,816,029; 5,826,400; 5,934,024; and 6,276,546. The bottles disclosed in these patents are incorporated herein by reference to illustrate some examples of the type and shape of bottles that can be used in the present invention. As can be appreciated, other types of plastic can be used to form the plastic container. As can further be appreciated, these plastic containers and others can be used to contain fluids other than beverages (e.g., food products other than beverages, cleaning products, automotive products, paint products, etc.). Many of these plastic containers are designed for use in the carbonated bottle industry. It is not uncommon that plastic containers originally designed for carbonated beverages are used for non-carbonated beverages. However, the use of these plastic containers has been problematic, especially during the bottling of the non-carbonated beverage. The gas in a carbonated beverage exerts a force on the interior of the container, thus resisting the deformation or collapse of the base of the container during the capping of the container. As a result, the base and walls of the plastic container can be made of a thinner material, which is a significant cost savings to the manufacturer. The absence of gas in non-carbonated beverages has resulted in increased deformation and/or damage of the base of the plastic container during the bottling process. In order to address this problem, increased wall thickness for the sidewalls and base of the plastic container has been used. Although the increased wall thickness of the plastic container reduces the incidence of deformation and/or damage of the base of the plastic container during the bottling process, the increased wall thickness translates into increased material costs. Plastic containers that include a plastic base attachment have also been used to address this problem. However, the use of the plastic base attachment also increases the cost of the container. Bottling manufacturers that bottle both carbonated and non-carbonated beverages typically must maintain additional inventory of various container configurations and thicknesses for bottling various types of beverages. The use of the bottle support plate of the present invention overcomes the need to have different types of plastic containers for bottling different types of beverages. As a result, the plastic container can be designed to have a low cost and weight, to be manufacturable from a plastic material by molding with minimal plastic material in its walls, to have excellent stability in both filled and unfilled conditions, and to have maximal volumes with minimal heights in easily handled diameters. The plastic container includes a neck portion, a sidewall portion and a lower bottom-forming portion. The body and/or base of the plastic container can be formed and/or configured to resemble configurations commonly used in prior art plastic bottles for carbonated and non-carbonated beverages. In one embodiment of the invention, the sidewall of the plastic container has a generally cylindrical shape; however, other shapes can be used. In one aspect of this embodiment, the sidewall can include one or more ribs to provide structural rigidity to the sidewall and/or to form a more aesthetically pleasing container design. In another and/or alternative aspect of this embodiment, the sidewall can include a region having a differing diameter than other portions of the sidewall to accommodate a label, to enhance the ability of a user to grasp the plastic container, to provide structural rigidity to the sidewall and/or to form a more aesthetically pleasing plastic container design. In another and/or alternative embodiment of the invention, the lower bottom-forming portion of the plastic container can be formed into a variety of configurations such as, but not limited to, a lower bottom-forming portion having a plurality of feet, a lower portion bottom-forming having a champagne configuration, a lower bottom-forming portion having a substantially flat base, and the like. In one aspect of this embodiment, the lower bottom-forming portion includes hollow feet-forming portions and intervening downwardly convex, smoothly curving bottom segments which can provide, through a plastic container bottom section of minimal height, substantially maximal container volume for a given container height, a maximal cylindrical sidewall labeling height, and a lower center of gravity and wide foot print for greater container stability, when filled and unfilled, and with minimal stress concentrations and risk of stress cracking and/or other types of defects. In one design of this aspect, the plastic container includes a cylindrical sidewall portion and a lower bottom-forming portion having a plurality of circumferentially-spaced, downwardly convex segments extending downwardly from the cylindrical sidewall and a plurality of intervening, circumferentially-spaced, totally convex, hollow foot-forming portions that extend radially from the central bottom portion and downwardly from the downwardly convex segments to form a clearance for a concave central bottom portion. In another and/or alternative design of this aspect, the plastic container includes a cylindrical sidewall portion all about a central longitudinal axis, a lower bottom-forming portion including a plurality of hollow foot-forming portions extending outwardly from the central portion of the lower bottom-forming portion to form a plurality of feet, each foot-forming portion including, between the central portion of the lower bottom-forming portion and its foot, a bottom clearance-forming portion including a compound-curved offset formed by opposing radii of curvature wherein the compound-curved offset curving downwardly from the central portion about a radius of curvature below the bottom of the lower bottom-forming portion before curving about a radius of curvature above the bottom of the lower bottom-forming portion, and a plurality of smoothly curved, downwardly convex segments between adjacent pairs of hollow foot-forming portions, each of the downwardly convex segments extending upwardly between the adjacent hollow foot-forming portions and, generally expanding outwardly at its upper end to merge into the cylindrical sidewall portion. In another and/or alternative aspect of this embodiment, the lower bottom-forming portion includes a plurality of ribs extending from the sidewall to a central portion of the lower bottom-forming portion where the ribs intersect. The upper curvilinear surface of the ribs lies on an essentially hemispherical curve in the interior of the container. In one design of this aspect, the lower bottom-forming portion includes a plurality of uniquely designed feet which extend along a curved path from the sidewall, have end walls connected to adjacent ribs and include a generally horizontal base surface. This configuration of the lower bottom-forming portion depicts a pseudo-champagne appearance wherein the feet contain a substantially vertical inner surface or lip positioned radially inwardly from the base surface and connected to a second inner surface which extends from the substantially vertical lip to the central portion of the bottom structure. Thus, the inner surfaces of the feet define a pseudo-champagne dome below the central portion and below the hemispherical bottom contour defined by the upper rib surfaces. In yet another and/or alternative aspect of this embodiment, the lower bottom-forming portion includes an essentially hemispherical curve in the interior of the container. This configuration of the lower bottom-forming portion depicts a champagne appearance. In still another and/or alternative embodiment of the invention, the plastic container includes an upper mouth-forming portion adapted to receive a fluid and a cap to cover the upper mouth. The design and configuration of the mouth opening can be generally the same as used in prior art plastic bottles used for carbonated beverages; however, it can be different. In one aspect of this embodiment, the opening in the upper mouth-forming portion is substantially circular. In another and/or alternative aspect of this embodiment, the upper mouth-forming portion includes one or more threads that are adapted to receive a cap. The one or more threads have a configuration that is generally the same as the threads used on prior art plastic bottles; however, it can be different. In yet another and/or alternative embodiment of the invention, the upper mouth-forming portion includes an anti-rotation flange adapted to inhibit or prevent the plastic container from rotating when the anti-rotation flange at least partially engages the bottle support plate and a cap is inserted onto the upper mouth-forming portion of the plastic bottle.

In still another and/or alternative aspect of the present invention, the bottle support plate at least partially supports the container during the capping and/or fluid filling process, thereby at least partially countering the downward force being applied to the top of the container during the capping and/or fluid filling process. In one embodiment, the bottle support plate fully supports the container during the capping process, thereby countering most, if not all, of the downward force being applied to the top of the container during the capping process. In another and/or alternative embodiment of the invention, the bottle support plate fully supports the container during the liquid filling process, thereby countering most, if not all, of the downward force being applied to the container during the fluid filling process. In still another and/or alternative embodiment of the invention, the bottle support plate is designed so as to receive at least a portion of the container below the anti-rotation flange of the container such that at least a portion of the bottom surface of the anti-rotation flange engages a support ledge of the bottle support plate when the bottle support plate is at least partially supporting the container. In one aspect of this embodiment, the support ledge of the bottle support plate includes a side opening adapted to at least partially receive a portion of the container below the anti-rotation flange. In one particular non-limiting design, the opening in the support ledge includes a generally C-shaped configuration; however, other shapes can be used. The C-shaped configuration is generally used for containers having a generally circular portion beneath the anti-rotation flange of the container. As can be appreciated, when the shape of the container beneath the anti-rotation flange is not generally circular, other configurations can be used for the support ledge of the bottle support plate to closely match such other shapes. In another and/or alternative non-limiting design, the C-shaped configuration is sized so as to inhibit or prevent the anti-rotation flange of the container from passing through the support ledge when the container is being filled and/or capped. In still another and/or alternative non-limiting design, the opening in the support ledge is shaped and sized to support no more that about 50–55% of the under side of the outer perimeter of the anti-rotation flange of the container when the container is being at least partially supported by the support ledge during the filling and/or capping process. Typically, the opening in the support ledge is shaped and sized to support no more that about 49% of the under side of the outer perimeter of the anti-rotation flange of the container.

In yet another and/or alternative aspect of the present invention, the bottle support plate includes an anti-rotation wall that is adapted to at least partially engage the outer perimeter of the anti-rotation flange of the container to inhibit or prevent the container from rotating when a cap is applied to the mouth of the container during the capping process. The anti-rotation wall effectively inhibits or prevents rotation of the container when the anti-rotation wall engages a container that has a non-circular anti-rotation flange. In prior bottling operations, prior art plastic bottles were prevented from rotating during the capping process by using a sharp implement to engage a portion of the prior art plastic bottle (e.g. circular flange, bottle base, etc.) to prevent rotation of the plastic bottle. The use of the sharp implement typically disfigured the prior art plastic bottles and made the prior art plastic bottles less aesthetically pleasing to consumers. The sharp implement also damaged some prior art plastic bottles during the capping process, thereby resulting in the bottles having to be destroyed. Other prior bottling operations used an anti-rotation plate that engaged the base of the prior art plastic bottle to prevent rotation of the prior art plastic bottle during capping. However, for non-carbonated beverages, the base of the plastic bottle tended to be more susceptible to deformation or damage by an anti-rotation plate. This is believed to be the result of the lack of carbonation in the fluid in the plastic bottle, which carbonation exerts a pressure force on the inside of the plastic bottle during the capping process, thereby resisting deformation or damage by an anti-rotation plate. Non-carbonated beverages do not have the carbonated pressure, thus the prior art plastic bottle is more susceptible to deformation or damage to the base by an anti-rotation plate. The use of the anti-rotation flange on the modified plastic container eliminates the need for use of a sharp implement and/or use of an anti-rotation plate during the capping process. As such, deformation and/or damage to the modified plastic container during the capping process is reduced or eliminated. In one embodiment of the invention, the bottle support plate includes an anti-rotation wall that at least partially mates with the non-circular anti-rotation flange of the container. In one embodiment of the invention, the anti-rotation wall of the bottle support plate is configured to at least partially mate with an anti-rotation flange that includes a plurality of substantially straight surfaces positioned about at least a portion of the anti-rotation flange. In one aspect of this embodiment, the anti-rotation wall of the bottle support plate is configured to at least partially mate with an anti-rotation flange that includes an odd number of straight surfaces. In one particular, non-limiting design, the anti-rotation wall of the bottle support plate is configured to at least partially mate with an anti-rotation flange having a plurality of substantially straight surfaces which have substantially the same length. In another and/or alternative particular, non-limiting design, the anti-rotation wall of the bottle support plate is configured to at least partially mate with an anti-rotation flange having a plurality of substantially straight surfaces that form a polygonal shape (e.g. pentagon, heptagon, nonagon, etc.). In another and/or alternative embodiment of the invention, the anti-rotation wall of the bottle support plate is configured to at least partially mate with an anti-rotation flange that includes at least one notch. In one aspect of this embodiment, the anti-rotation wall of the bottle support plate is configured to at least partially mate with an anti-rotation flange having one or more sides of at least one notch having a substantially straight surface. In one particular, non-limiting design, the anti-rotation wall of the bottle support plate is configured to at least partially mate with an anti-rotation flange having all the sides of at least one notch that are formed by substantially straight surfaces. In another and/or alternative aspect of this embodiment, the anti-rotation wall of the bottle support plate is configured to at least partially mate with an anti-rotation flange having one or more sides of at least one notch that is formed by an arcuate surface. In one particular, non-limiting design, the anti-rotation wall of the bottle support plate is configured to at least partially mate with an anti-rotation flange having all the sides of at least one notch formed by an arcuate surface. In still another and/or alternative aspect of this embodiment, the anti-rotation wall of the bottle support plate is configured to at least partially mate with an anti-rotation flange that includes a plurality of notches. In one particular, non-limiting design, the anti-rotation wall of the bottle support plate is configured to at least partially mate with an anti-rotation flange having a plurality of notches that are substantially symmetrically oriented about the anti-rotation flange. In yet another and/or alternative aspect of this embodiment, the anti-rotation wall of the bottle support plate is configured to at least partially mate with an anti-rotation flange wherein the size and/or shape of two or more of the notches are substantially the same. In yet another and/or alternative embodiment of the invention, the anti-rotation wall is shaped and sized to engage no more that about 50–55% of the outer perimeter of the anti-rotation flange of the container when the container is being at least partially supported by the support ledge of the bottle support plate during the filling and/or capping process. Typically, the anti-rotation wall is shaped and sized to engage no more that about 49% of the outer perimeter of the anti-rotation flange of the container. As can be appreciated, the anti-rotation wall can be shaped and sized to engage more that 55% of the outer perimeter of the anti-rotation flange of the container.

In still yet another and/or alternative aspect of the present invention, the bottle support plate includes a support ledge and an anti-rotation wall that partially or fully counter the downward force applied to the upper portion of the container during the capping process. During prior capping processes, the capping machine exerted a downward force on the cap as the cap was inserted onto the mouth of the container. Typically, the cap was threaded onto the upper mouth-forming portion of the container as a downward force was being applied to the cap; however, other techniques were used to insert the cap on the container. This downward force could result in the base of the container becoming deformed and/or damaged during the capping process. When carbonated beverages were inserted into the container, the carbonated gas exerted a force on the inside surfaces of the container that reduced or prevented deformation and/or damage to the base of the container during the capping process. During the bottling of non-carbonated beverages, the lack of carbonated gas resulted in the base of the container being more susceptible to deformation and/or damage during the capping process. Some bottle manufactures attempted to overcome this problem by inserting a protective cap on the base of prior art plastic bottles. Although the protective cap was effective in reducing the incidence of deformation and/or damage to the base of these container during the capping process, the use of the cap increased material costs of the container and typically required some modification to the bottling line in order to properly convey the container to and/or from the container filling location. In one embodiment, the bottle support plate is designed to at least partially support the container at and/or below the anti-rotation flange of the container during the capping process, such that the downward force applied to the cap during the capping process is partially or fully countered by the bottle support plate. As a result, a reduced amount of force is exerted on the base of the container during the capping process which results in the reduction or elimination of deformation and/or damage to the base of the container. In one aspect of this embodiment, the bottle support plate is positioned such that when the anti-rotation flange is supported by the support plate, the base of the container is suspended as the cap is at least partially inserted on the mouth of the container. As such, prior art anti-rotation wear plates are not required.

In a further and/or alternative aspect of the present invention, the bottle support plate includes an anti-rotation wall that extends upwardly from the support ledge of the bottle support plate. In one embodiment of the invention, the front surface of the anti-rotation wall is substantially perpendicular to at least a portion of the support ledge. In another and/or alternative embodiment of the invention, at least a portion of the front surface of the anti-rotation wall is non-perpendicular to at least a portion of the support ledge. In one aspect of this embodiment, at least a portion of the front surface of the anti-rotation wall forms an angle with at least a portion of the support ledge that is between about 90–130°, and more typically about 90–110°, and even more typically about 95–105°. The angling of the anti-rotation wall facilitates in the proper positioning of the anti-rotation flange of the container on the bottle support plate. In addition, the angling of the anti-rotation wall facilitates in the removal of the anti-rotation flange of the container from the bottle support plate after the cap has been inserted onto the container. In another and/or alternative embodiment of the invention, the height of the anti-rotation wall from the support ledge is substantially uniform. In still another and/or alternative embodiment of the invention, the height of the anti-rotation wall from the support ledge at least partially varies. In yet another and/or alternative embodiment of the invention, the anti-rotation wall is at least partially spaced from at least a portion of the front edge of the support ledge. In one aspect of this embodiment, the width of the support ledge defined between the front edge of the support ledge and the anti-rotation wall at least partially varies. In another and/or alternative aspect of this embodiment, the width of the support ledge defined between the front edge of the support ledge and the anti-rotation wall is substantially uniform.

In still a further and/or alternative aspect of the present invention, the bottle support plate includes a support ledge that is recessed from the top surface of the bottle support plate. The recess provides a space to allow the capping mechanism to insert a cap on the container without having to contact the bottle support plate. As can be appreciated, the recess in the bottle support plate is not required. In one embodiment, the recess has a semi-circular shape to accommodate the shape of the capping mechanism. As can be appreciated, other shapes of the recess can be used.

In yet a further and/or alternative aspect of the present invention, the bottle support plate is removably connected to the bottling and/or capping mechanism. Bottling machines commonly include a rotatable star wheel and a rear container guide assembly spaced radially outwardly from the rotatable star wheel to retain the container within the rotatable star wheel. The rotatable star wheel typically includes a hub secured to a vertically extending drive shaft which rotates about a drive shaft axis. Extending radially outwardly from the hub are typically one or more bottle support assemblies. Each bottle support assembly is mounted on the star wheel. The bottle support plate is designed to be removably connected to one or more of the bottle support assemblies. The ability to remove the bottle support plate from the bottle support assembly results in 1) easier repair and/or replacement of a damaged bottle support plate, 2) less down time for the repair and/or replacement of a damaged bottle support plate, and/or 3) the ability to quickly and easily change out one or more bottle support plates to accommodate a certain type of container. In one embodiment, the bottle support plate is connected to the bottle support assembly by use of, but not limited to, bolts, screws, pins, adhesives, clamps, latches, nails, and the like. As can be appreciated, the bottle support plate can be essentially irremovably connected to the bottle support assembly. If such a connection is desired, it can be accomplished by a variety of means such as, but not limited to, welding, soldering, bolts, screws, pins, rivets, adhesives, clamps, latches, nails, and the like.

The principal object of the present invention is to provide a bottling and/or capping mechanism that reduces or prevents damage to a container during the capping and/or filling of the container.

Another and/or alternative object of the present invention is to provide a bottling and/or capping mechanism that includes a bottle support plate that at least partially engages an anti-rotation flange of a container, thereby inhibiting or preventing deformation and/or damage to the container during the capping and/or filling of the container.

Yet another and/or alternative object of the present invention is to provide a bottling and/or capping mechanism that can be used to fill and cap containers with non-carbonated fluids and/or carbonated fluids.

Still another and/or alternative object of the present invention is to provide a bottling and/or capping mechanism that includes a removable bottle support plate.

Still yet another and/or alternative object of the present invention is to provide a bottle support plate that can be used on existing bottling and/or capping mechanisms.

A further and/or alternative object of the present invention is to provide a mechanism for inhibiting or preventing container rotation in a bottling and/or capping machine which is operable on either plastic or glass containers.

Still a further and/or alternative object of the present invention is to provide an arrangement for preventing container rotation in a bottling and/or capping machine in which the containers are not marked or scored in any deleterious manner.

Yet a further and/or alternative object of the present invention is to provide an anti-rotation device in a bottling and/or capping machine which does not cause failure of the container.

Still yet a further and/or alternative object of the present invention is to provide an economical, easily replaceable mechanism for preventing container rotation in a bottling and/or capping machine.

These and other advantages will become apparent to those skilled in the art upon the reading and following of this description taken together with the accompanying drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE INVENTION

Figure 1:
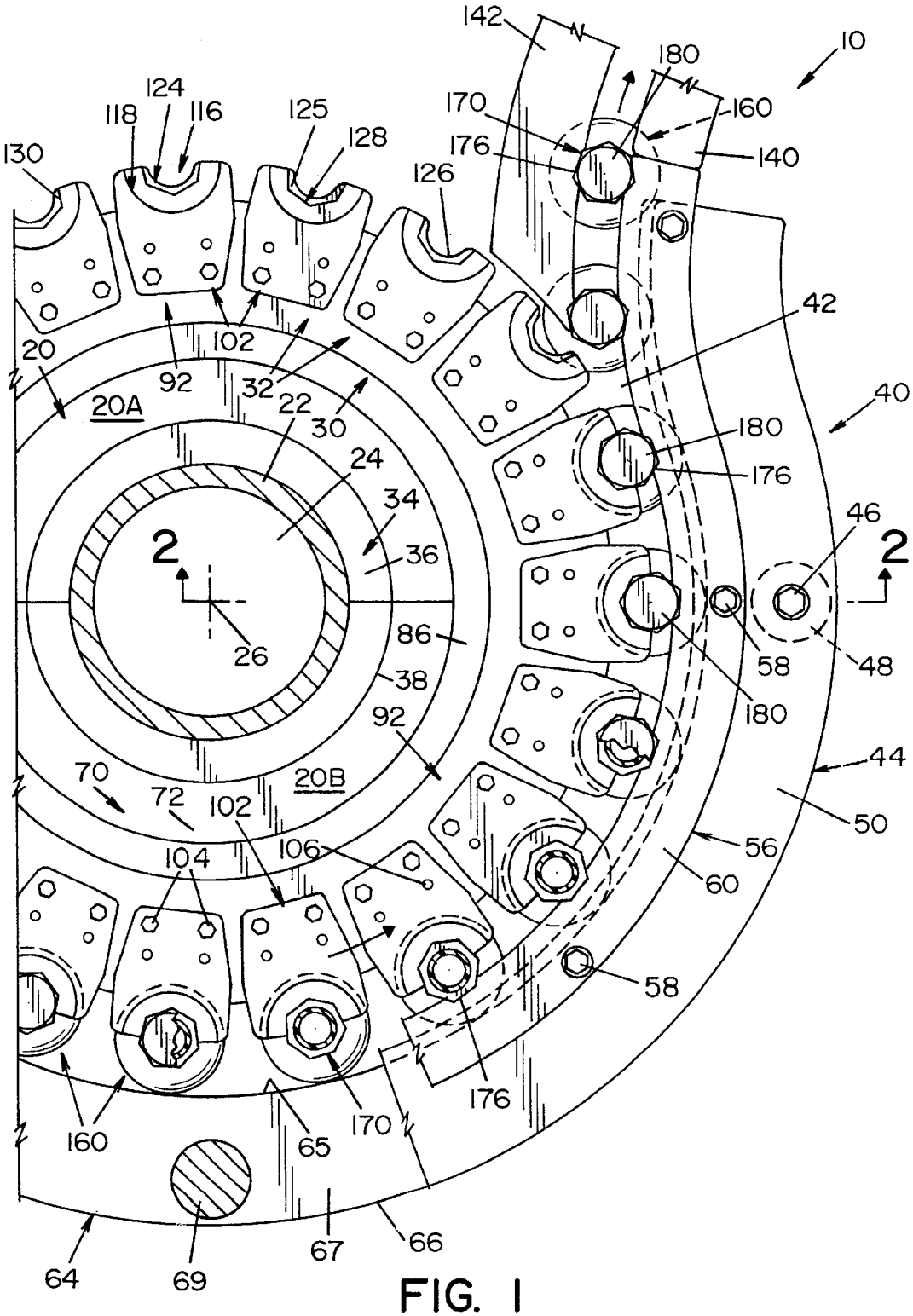
FIG. 1 is a partial plan view of a bottling machine employing the rear container guide assembly of the present invention.
Figure 2:
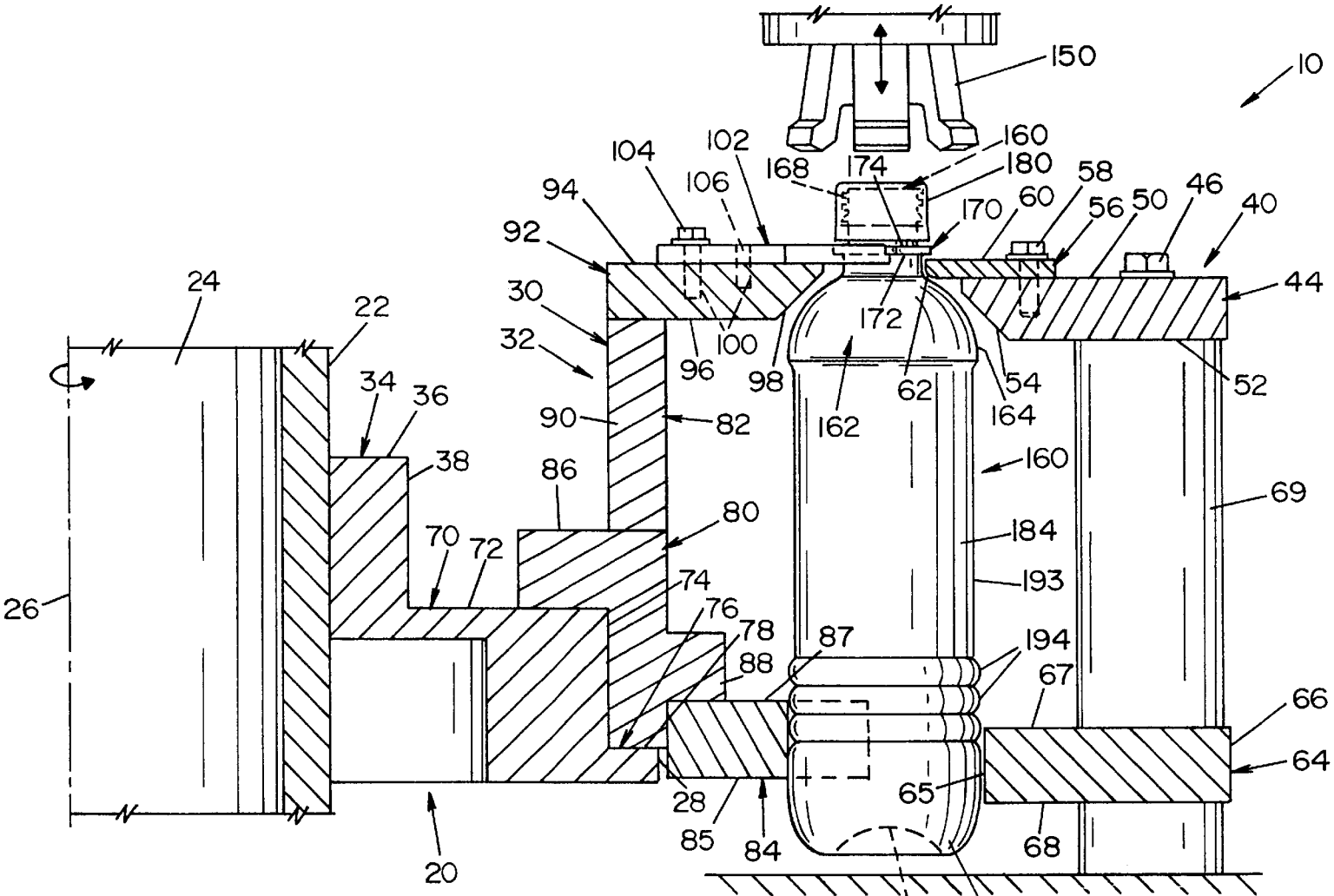
FIG. 2 is a cross-sectional elevation view taken along line 2—2 of FIG. 1.

Referring now to the drawings wherein the showing is for the purpose of illustrating preferred embodiments of the invention only and not for the purpose of limiting the same, FIGS. 1 and 2 show various portions of what is defined as a bottling machine 10. The bottling machine as defined herein includes the filling and/or the capping bottling equipment. The filling equipment is that which fills containers with product, such as, but not limited to, a non-carbonated beverage. The capping equipment is that which applies a cap, crown or other closure to the container.

Bottling machine 10 includes a rotatable star wheel 20 and a rear container guide assembly 40 spaced radially outwardly from rotatable star wheel 20 for retaining the bottles 160 within rotatable star wheel 20. Depending upon the application of bottling machine 10, an additional star wheel (not shown) or conveyor (not shown) is mated to rotatable star wheel 20 at a fixed entry point (not shown) on rotatable star wheel 20. Bottles 160 are rotated out of rotatable star wheel 20 at a fixed exit point 42 to an outfeed star wheel (not shown) or conveyor (not shown) leading to further processing or handling equipment.

FIG. 2 illustrates a capping machine having capper head 150 for placing a closure 180 on bottle 160. Rotatable star wheel 20 essentially comprises a hub 22 secured to a vertically extending drive shaft 24 which rotates about a drive shaft axis 26.

Extending radially outwardly from hub 22 are a plurality of bottle support assemblies 30. As shown, each of bottle support assemblies 30 is mounted on star wheel 20 at a bottle support station 32. Each of bottle support assemblies 30 is arranged about the periphery 28 of rotatable star wheel 20, which is generally circular. Each bottle support assembly 30 is removable from star wheel 20 through other embodiments, known in the industry.

Rear container guide 40 includes an annular rear neck guide 44 secured in a stationary manner by bolts 46 to a frame member 48. Rear neck guide 44 has a top surface 50, a bottom surface 52 and an inclined edge surface 54 which extends radially outwardly from top surface 50 to bottom surface 52. An annular neck block 56 is secured by fasteners 58 to top surface 50 of rear neck guide 44. Neck block 56 has a top surface 60 which, as shown in FIG. 2, is adapted to be in contact with the underside 172 of anti-rotation flange 170 of bottle 160. Neck block 56 also includes an inclined edge surface 62 extending radially outward from top surface 60. Fixed rear guide 40 and specifically annular neck block 56 functions to support anti-rotation flange 170 and bottle 160 by retaining bottle 160 on rotatable star wheel 20.

Star wheel 20 extends radially outwardly from hub 22 and has an annular neck portion 34 secured at its inner end to hub 22. Specifically, a neck portion top surface 36 extends radially outwardly to a neck portion edge surface 38 which is generally coaxial with drive shaft axis 26. 20 Neck portion edge surface 38 terminates at a support plate portion 70 having a support plate top surface 72 which also extends radially outward from hub 22 and is generally parallel to top surface 36. Support plate top surface 72 extends radially outwardly to a support plate edge surface 74 which then extends downwardly to a ledge plate portion 76 having a ledge plate top surface 78 parallel to both of top surfaces 36 and 72. Top surface 78 extends radially outwardly to periphery 28 of star wheel 20.

As shown, star wheel 20 is used on large capacity bottling machines. This means that periphery 28 is circular and shaft 24 is fitted with a single hub 22 and star wheel 20 can be used with many different sizes of bottles run on the same bottling line. Bottle support assemblies 30 for each size bottle are provided and are also capable of being removed and replaced for different size bottle applications. It will be appreciated that for smaller capacity machines or for different applications within the same bottling line, a star wheel may instead comprise a hub and star wheel portion having individual pockets within the star wheel itself that serve a function similar to bottle support assembly 30. In such an instance, individual hubs are designed and removable when it is desired to convert a line to different size bottles. It will be appreciated that in this instance, star wheel 20 is split into two halves 20A and 20B to permit installation and repair without disturbing, for instance, capper head 150 shown schematically in FIG. 2, and further to allow ease of assembly and disassembly by reducing the weight of individual pieces. Such difference in a hub does not affect the present invention.

Bottle support assemblies 30 comprise three distinct pieces including a neck support bracket 80, a neck guide 82 and a bottom body guide 84. Neck support bracket 80 is attached to star wheel 20 with neck guide 82 attached to a top surface 86 of neck support bracket 80 and bottom body guide 84 attached to guide support 88 of neck support bracket 80.

Neck guide 82 includes a vertical standard 90 extending upwardly from top surface 86 and a bracket 92 extending perpendicular from vertical standard 90 radially outwardly. Bracket 92 includes a top surface 94, a bottom surface 96 and an inclined edge surface 98 which extends radially outwardly from top surface 94 to bottom surface 96. The top surface includes four openings 100. Anti-rotation plate or bottle support plate 102 is secured to top surface 94 of bracket 92 by hex-screws 104 and pins 106. Anti-rotation plate 102 includes two openings 108 for screws 104 and two openings 110 for pins 106, which are used to secure and position the anti-rotation plate to bracket 92. One or more anti-rotation plates can be removed from bracket 92 and replaced by simply removing the screws. As can be appreciated, other means for connecting the anti-rotation plate to the bracket in a removable or non-removable manner can be used (e.g. bolts, nails, clips, welding, soldering, rivets, adhesive, clamps, and/or the like).

Figure 3:
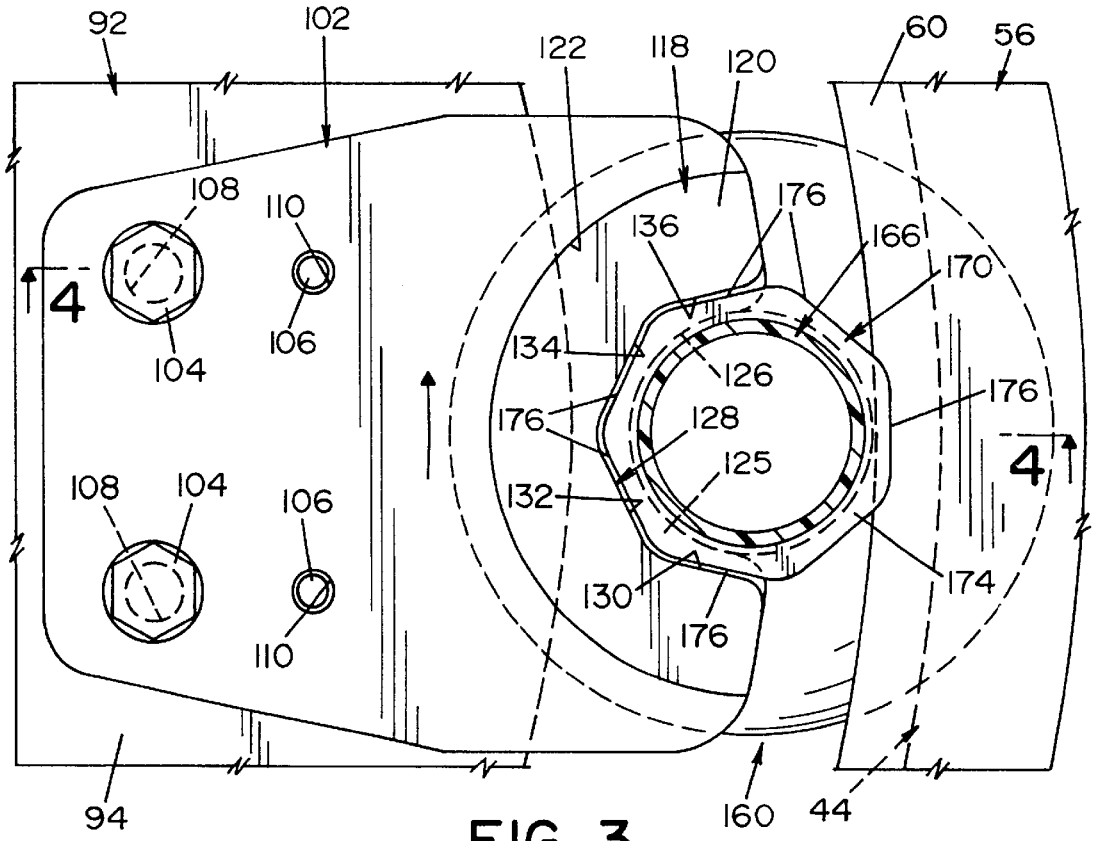
FIG. 3 is a partial plan view of a bottle support plate and guide rail in accordance with the present invention.
Figure 4:
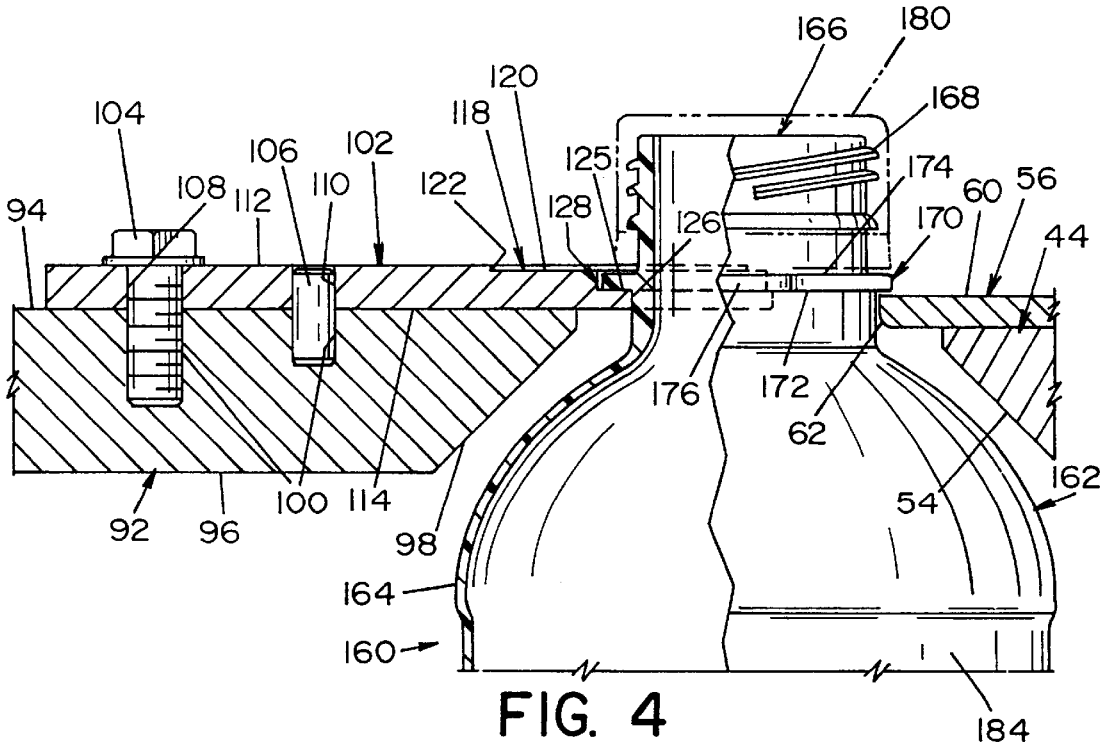
FIG. 4 is a cross-sectional elevation view taken along line 4—4 of FIG. 3.
Figure 5:
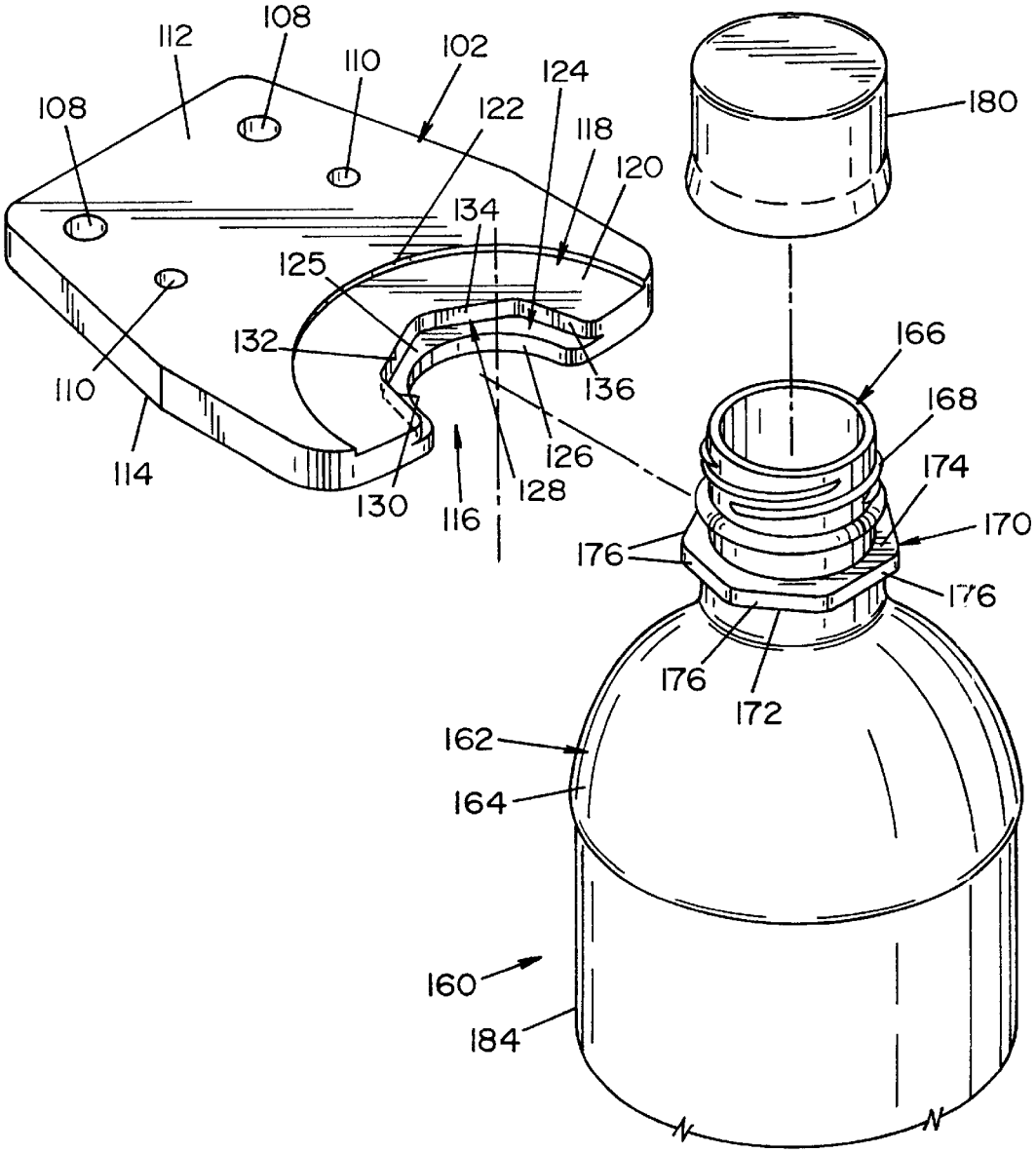
FIG. 5 is an exploded perspective view showing the support plate, the anti-rotation flange of a bottle and the cap for the bottle.

Referring now to FIGS. 3–5, anti-rotation plate 102 has a top surface 112 and a bottom surface 114. Each anti-rotation plate includes a pocket 116 that is adapted to receive anti-rotation flange 170 of bottle 160. As shown in FIG. 3, the width of the anti-rotation plate is greater at the end including the pocket than at the end including openings 108. The narrowing of the anti-rotation plate at the connection end facilitates connecting and orienting multiple anti-rotation plates on bracket 92. As can be appreciated, other configurations of the anti-rotation plate can be used to facilitate in connecting and orienting multiple anti-rotation plates on bracket 92.

The top surface of the anti-rotation plate includes a recessed region 118 that surrounds pocket 116. The top surface 120 of recessed region 118 generally lies in the same plane as top surface 112. End wall 122 is generally perpendicular to top surfaces 112 and 120. As can be appreciated, end wall 122 can be oriented non-perpendicular to top surface 120. The recessed region provides clearance for capper head 150 during the capping process. As can be appreciated, the recessed region can be eliminated from the anti-rotation plate.

Figure 6:
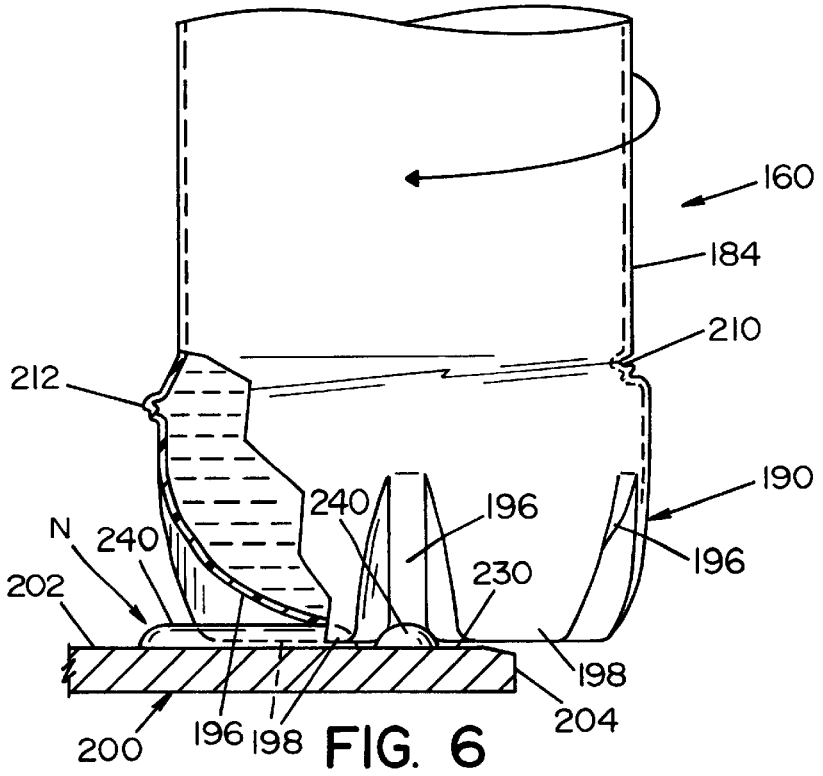
FIG. 6 is a partial plan view of the base of a bottle that is damaged as a cap is inserted on the bottle; and, FIG. 7 is a partial plan view of the base of a bottle that is damaged during the filling and/or capping of the bottle.
Figure 7:
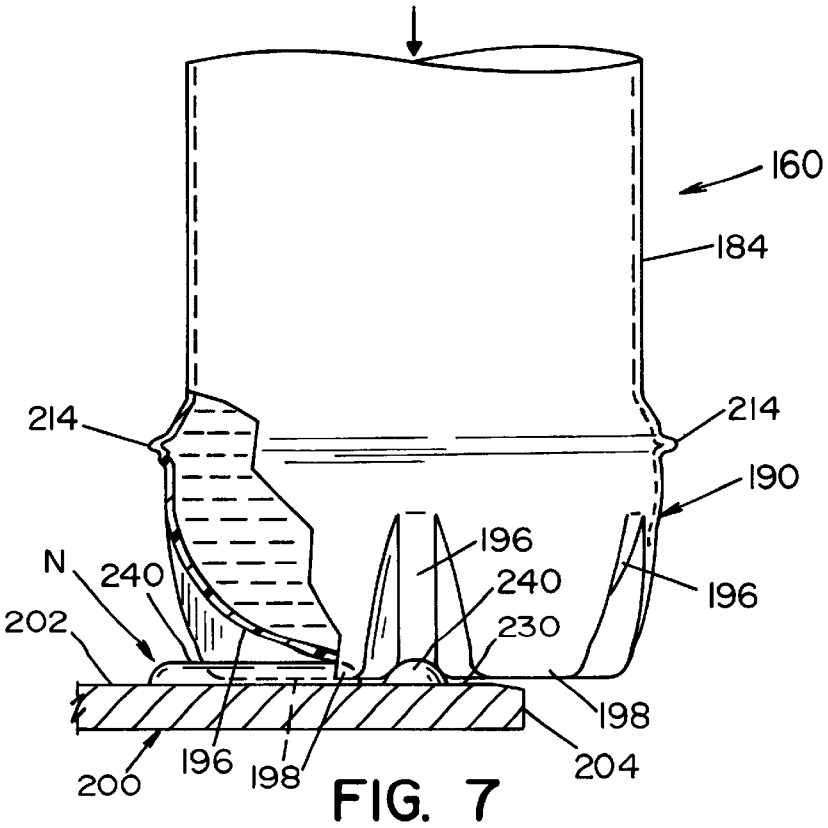

Pocket 116 includes a support ledge 124 that is adapted to partially or fully support bottle 160 during the bottling and/or capping process. As such, deformation and/or damage to the base of the bottle, such as plastic bottles, during the bottling and/or capping process in reduced or eliminated. Such damage to prior bottles is disclosed in FIGS. 6 and 7. As illustrated in FIGS. 6 and 7, bottle 160 includes a pedaloid base configuration 190 that includes a plurality of diverging recesses 196 forming a plurality of legs 198. The base of bottle 160 rests on receiving nests N on a standard wear plate 200. The wear plate has an upper flat surface 202 and an outer periphery 204. Each of the individual nests N has an inner area 230 constituting a portion of flat surface 202 and having a center aligned with center of bottle 160 where the bottle rests upon its individual nest N. At least one bar-like abutment 240 extends radially outward from the center of nest N. If more than one abutment is positioned on the nest, the abutments are typically spaced from one another by an angle determined by the formula 360°/X, wherein X is the number of recesses on the base of bottle 160. During the bottling and/or capping process, bottle 160 is positioned onto nest N such that the rod-like abutments fit into the recesses of the base of bottle 160 as shown in FIGS. 6 and 7. The abutments thereafter prevent rotation of the bottle during the bottling and/or capping process. The configuration of such a wear plate and nest and the positioning of the bottles in such nests is described in detail in U.S. Pat. No. 5,934,042, which is incorporated herein by reference. As illustrated in FIG. 6, the abutments inhibit or prevent the base of bottle 160 from rotating in the direction of the arrow during the capping process. However, damage to the bottle periodically occurred, especially when bottling non-carbonated beverages, during the capping processes. As shown in FIG. 6, the side of bottle 160 is damaged by being twisted thus resulting in a collapsed section 210 and a bulging section 212. The twisted bottle was caused by the rotational force applied to the top of the bottle by the capping machine as indicated by the arrow and the immobility of the base of the bottle cased by the abutments in the wear plate. Referring now to FIG. 7, bottle 160 is shown to be damaged by the downward force as indicated by the arrow that is being applied to the top of the bottle during the bottling and/or capping process. The damage to the bottle is illustrated by the bulging section 214 about the perimeter of the side of the bottle. During the capping process, the capper exerts a downward force on the bottle during the insertion of the cap on the bottle. Top surface 202 of the wear plate prevents the bottle from moving downward, thus the downward force is absorbed by the bottle, thus resulting in periodic damage to the bottle as exemplified in FIG. 7.

As set forth above, pocket 116 is adapted to partially or fully support bottle 160 during the capping process, thus inhibiting or preventing deformation and/or damage to bottle, such as plastic bottles, during the bottling and/or capping process. Support ledge 124 includes a top surface 125 which generally lies in the same plane as top surface 112. Support ledge 124 is designed to receive underside 172 of anti-rotation flange 170 of bottle 160. The front face 126 of the support ledge is semi-circular in configuration and encompasses an angle of up to about 180°. The semi-circular configuration of the front face is adapted to receive the circular portion of the neck of the bottle located below the anti-rotation flange. As can be appreciated, the shape of the front face can be other than semi-circular. Extending upwardly from the support ledge and to the top surface of the recessed region is anti-rotation wall 128. The plane of the anti-rotation wall is generally perpendicular to top surface 120 and support ledge 124. As can be appreciated, the plane of the anti-rotation wall can be oriented so as to form an angle of between about 90–130° between the anti-rotation wall and support ledge 124. The top portion of the anti-rotation wall can abruptly converge with top surface 120 of recessed region 118, or have a smoother transition in the form of a curved surface.

Anti-rotation wall 128 includes four walls 130, 132, 134, 136 that are generally straight. Walls 132 and 134 have generally the same length, as do walls 130 and 136. The angle between the walls is about 140–143°. Such an angle accommodates a anti-rotation flange on the bottle having seven equally spaced sides (e.g. heptagon). As can be appreciated, the configuration of the anti-rotation wall can include more or less walls, and/or the one or more walls can have a non-straight surface. The configuration of the anti-rotation wall is selected so as to inhibit or prevent rotation of the anti-rotation flange of the bottle during the capping process when the anti-rotation flange is positioned in pocket 116.

When the anti-rotation flange of the bottle is positioned in pocket 116 of the anti-rotation plate, top surface 60 of neck block 56 is positioned at an area diametrically opposed to pocket 116. Contact with top surface 60 coacts with anti-rotation plate 102 and functions to maintain bottle 160 within pocket 116 as star wheel 20 rotates. Pocket 116 inhibits or prevents rotation of bottle 160 when a closure 180 is tightened thereon by capper head 150.

In one particular non-limiting configuration of the pocket of the anti-rotation plate, the anti-rotation plate is made of stainless steel (e.g. 304, 316, etc.). As can be appreciated, the anti-rotation plate can be made of or include other materials. Typically the anti-rotation plate is electro-polished. The thickness of the anti-rotation plate is about 0.1875 inch. As can be appreciated, other thicknesses can be used. Openings 108 have a diameter of about 0.28 inch and openings 110 have a diameter of about 0.19 inch. As can be appreciated, other shapes and sizes of the openings can be used. Recessed region is recessed about 0.016 inch and has a radius of about 1.125 inch. As can be appreciated, other depths of the recess can be used. Alternatively, it can be appreciated that the recess can be eliminated from the anti-rotation plate. The height of anti-rotation wall is about 0.093 inch. As can be appreciated, other heights can be used. The anti-rotation wall has four walls having an angle of about 141.43° between the walls. As can be appreciated, other angles can be used and/or other numbers of walls can be used. The distance of the center of each wall from the center of pocket 116 is about 0.618 inch. As can be appreciated, other distances can be used. The front face of support ledge 124 has a radius of curvature of about 0.531 inch. As can be appreciated, other radii of curvature can be used. As a result, the width of the support ledge from the center of each wall 130, 132, 134, 136 to front face 126 is about 0.087 inch.

As shown in FIG. 2, bottom body guide 84 includes a body guide bottom surface 85 and a body guide upper surface 87. Bottom body guide 84 is rigidly attached to neck support bracket 80 and specifically to guide support 88. It will be appreciated that each bottom body guide 84 can have a retaining pocket (not shown) having a semi-circular cross section. As such, bottom body guide 84 contacts the sidewall of bottle 160 at an area vertically downward from pocket 116 of anti-rotation plate 102 and at an area diametrically opposed to a sidewall contact established by an annular sidewall rear guide 64 to retain bottle 160 substantially vertical while star wheel 20 rotates bottles 160 from a fixed entry point to fixed exit point 42.

Annular sidewall rear guide 64 has an inner radial surface 65 and an outer surface 66, the radius of each surface 65 and 66 terminating at drive shaft axis 26. Sidewall rear guide 64 includes an upper surface 67 and a lower surface 68. A through-sleeve extends between upper surface 67 and lower surface 68 at least one location in sidewall rear guide 64. It will be appreciated that the relative size and relationship of rear guide 64 can remain generally constant for many size bottles since, for instance, the diameter of a one-liter, a 12-ounce and a 20-ounce bottle are generally the same. It will also be appreciated that the that rear guide 64 can be completely changed out and replaced with a different size rear guide 64. Suspended from rear neck guide 44 is at least one vertical post or positioning rod 69. The positioning rod can include circumferential concave grooves (not shown) spaced along a length between the lower end and an upper end of the vertical post. Vertical post 69 is attached to rear neck guide 44 by the hex head bolts 46. Sidewall rear guide 64 can be attached to vertical post 69 by various means. One such arrangement is disclosed in U.S. Pat. No. 5,732,528, which is incorporated herein by reference.

Referring now to FIGS. 2–5, bottle 160 is in the form of a non-carbonated beverage bottle. As can be appreciated, bottle 160 can also be used for carbonated beverages. Bottle 160 includes an upper neck and mouth-forming portion 162, a cylindrical sidewall portion 184 extending around the longitudinal axis of the container, and a lower base-forming portion 190. The upper neck and mouth-forming portion 162 provides a neck-forming transition 164 leading to the container mouth 166. The transition portion 164 can take any conveniently usable and moldable shape such as, but not limited to, a frustoconical shape, hemispherical shape, ogive shape, or some other shape. A thread 168 positioned adjacent mouth 166 is designed to accept a threaded cap 180 commonly used to close the beverage bottles; however, the mouth-forming portion of the containers can be provided with means to accommodate other types of closures.

The upper neck and mouth-forming portion 162 also includes an anti-rotation flange positioned above the transition portion 164. The anti-rotation flange includes an underside surface 172 and a topside surface 174. Underside surface 172 is adapted to be partially or fully supported in pocket 116 of anti-rotation plate during the capping process. Underside surface 172 is also adapted to be partially or fully supported by guide rails 140, 142 when the bottle is being conveyed to and/or from the bottling and/or capping apparatus as illustrated in FIG. 2. As shown in FIGS. 1, 3, and 5, the anti-rotation flange has seven sides 176 that form a generally heptagonal shape. The odd number of sides inhibits or prevents the anti-rotation flange from disengaging from guide rails 140, 142 when the bottle is being conveyed to and/or from the bottling and/or capping apparatus. The sides of the anti-rotation flange also enable one or more sides of the anti-rotation flange to partially or fully mate with the anti-rotation wall in pocket 116 to inhibit or prevent rotation the bottle during the capping process. As can be appreciated, the anti-rotation flange can be positioned in pocket 116 such that the anti-rotation flange is not ideally oriented in pocket 116. When the bottles are conveyed to the bottling and/or capping apparatus, the bottles are oriented in various positions. However, during the bottle's movement on the star wheel and/or during the capping process, the bottle will be rotated, thereby resulting in the anti-rotation flange becoming properly oriented with respect to the anti-rotation wall in pocket 116, thus resulting in the inhibiting or preventing of further rotation of the bottle during the capping process.

Although not shown, other configurations of the anti-rotation flange can be used on bottle 160 to inhibit or prevent rotation of the bottle during the capping process and/or inhibit or prevent the anti-rotation flange from disengaging from the guide rails when the bottle is being conveyed to and/or from the bottling and/or capping apparatus. Such other configurations can include, but are not limited to, an anti-rotation flange having five generally equal length sides thereby forming a pentagon, an anti-rotation flange having nine generally equal length sides thereby forming a nonagon, an anti-rotation flange having one or more notches, etc.

As shown in FIG. 2, lower base-forming portion 190 of container 160 includes a central portion 192 having a hemispherical or champagne-type configuration. As can be appreciated, lower base-forming portion 190 can have other configurations such as having a plurality of foot-forming portions as shown in FIGS. 6 and 7 formed about the central portion for supporting bottle 160.

The bottle can be formed into a variety of dimensions to satisfy a particular use. Typically, the bottle is sized for 16-ounce applications, 20-ounce applications, one-quart applications, one-liter applications, two-quart applications, two-liter applications, and one-gallon applications. As can be appreciated, other sized bottles can be used. For instance, a bottle for containing 20 ounces can have an overall height of about 7–9 inches, for filling within about 1.25–2 inches of the mouth. When the bottle is a plastic bottle, the upper neck and mouth-forming portion can be finished with a threaded opening (e.g. PCO-28 finish). As can be appreciated, a sports top that allows for easy opening and closing of the mouth can be additionally or alternatively inserted in the mouth of the bottle. The cylindrical sidewall of the bottle can have a maximum diameter of about 2.25–3.5 inches. A reduced label panel diameter 193 on the sidewall can be used as shown in FIG. 2. If such panel diameter is used, the diameter can be about 2–3.25 inches. Additionally and/or alternatively, the sidewall can include one or more ribs 194 extending about the central axis of the bottle. A number of other configurations can be incorporated on the sidewall for structural and/or aesthetic purposes. The neck-forming transition between the cylindrical sidewall and the mouth can be an ogive shape extending downwardly from about 0.5–1.5 inch below the mouth of to blend into the cylindrical sidewall approximately 2–3.5 inches below the mouth. The base of the bottle can be substantially flat, convex, and/or include a plurality of feet or legs. If the bottle is a plastic bottle that includes feet or legs, such configuration can be the same or similar to configurations disclosed in U.S. Pat. Nos. 4,978,015; 5,603,423; and 6,276,546, which are incorporated herein by reference.

In another example, a bottle for containing two liters can have an overall height of about 10–13 inches, for filling within about 1–2.25 inches of the mouth. The finish of the bottle, when made of plastic, can be a threaded opening with a PCO-28 finish. The cylindrical sidewall of the improved bottle can have a maximum diameter of about 3.5–5 inches. A reduced label panel diameter on the sidewall can be used. If such panel diameter is used, the diameter can be about 3.25–4.75 inches. Additionally and/or alternatively, the sidewall can include one or more ribs extending about the central axis of the bottle. A number of other configurations can be incorporated on the sidewall for structural and/or aesthetic purposes. The neck-forming transition between the cylindrical sidewall and the mouth can be an ogive shape extending downwardly from about 0.5–1.5 inch below the mouth to blend into the cylindrical sidewall approximately 3–5 inches below the mouth. The base of the bottle can be substantially flat, convex, and/or include a plurality of feet or legs. If the improved plastic container includes feet or legs, such configuration can be the same or similar to configurations disclosed above.

Bottle 160 can be formed by a number of standard techniques. Typically, when the bottle is formed of plastic, the bottle is formed from PET; however, other plastics can be used. Generally, the processing of the plastic bottle involves the injection molding of PET into what is commonly referred to as a "preform" and then blow-molding such preform into the improved plastic container. The bottle, when formed of plastic, can be formed by a conventional injection-molded preform. As known in the art, various configurations of preforms for a desired plastic bottle can be used to make various plastic bottle designs. The use of a particular preform with a particular plastic bottle design is a matter of design and the selection criteria. It may be advantageous to alter the design of the preform to optimize the final plastic bottle design. For instance, it may be advantageous to taper the bottom of the preform to allow better orientation and distribution of material. As can be appreciated, other alterations can be used. The improved plastic container can be formed by a conventional stretch blow-molding process.

The invention can thus provide durable bottle for carbonated and non-carbonated beverages. When the bottle is formed of plastic, the plastic bottle can be formed at a low cost and low weight manufacturable from plastic material by molding with minimal plastic material, with maximal volumes with minimal heights in easily handled diameters, with maximal height cylindrical sidewall portions, with excellent stability in both filled and unfilled conditions.

The present invention has been described with reference to a number of different embodiments. It is to be understood that the invention is not limited to the exact details of construction, operation, exact materials or embodiments shown and described, as obvious modifications and equivalents will be apparent to one skilled in the art. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

What is claimed is:

1. A bottle support plate for use in a rotary capping machine used to apply caps onto the upper threaded neck of one or more containers having a non-fully circular flange, as said containers are moved along a generally circular path by a star wheel, said bottle support plate connected to said star wheel and including a pocket that at least partially supports and at least partially receives and mates with the flange of said container to at least partially inhibit rotation of said container during the threading of a cap on said upper threaded neck of said container, said pocket including a support ledge and an anti-rotation wall, said anti-rotation wall extending upwardly from said support ledge, said anti-rotation wall having a non-fully curvilinear face designed to be at least partially matable with at least a portion of an outer periphery of the flange of said container to at least partially inhibit rotation of said container.

2. The bottle support plate as defined in claim 1, wherein said support ledge is designed to at least partially engage a bottom surface of said flange of said container.

3. The bottle support plate as defined in claim 2, wherein said support ledge at least partially counters a downward force applied to the upper threaded neck of said container during the threading of a cap on said upper threaded neck of said container.

4. The bottle support plate as defined in claim 1, wherein said support ledge includes a curvilinear shaped front surface, said anti-rotation wall having a front surface that is shaped differently from said front face of said support ledge.

5. The bottle support plate as defined in claim 1, wherein said anti-rotation wall includes at least one substantially straight surface.

6. The bottle support plate as defined in claim 5, wherein said anti-rotation wall includes a plurality of odd numbered straight surfaces.

7. The bottle support plate as defined in claim 6, wherein said plurality of straight surfaces designed to mate with at least a portion of an outer periphery of the flange of said container having a shape of a pentagon.

8. The bottle support plate as defined in claim 6, wherein said plurality of straight surfaces designed to mate with at least a portion of an outer periphery of the flange of said container having a shape of a heptagon.

9. The bottle support plate as defined in claim 6, wherein said plurality of straight surfaces designed to mate with at least a portion of an outer periphery of the flange of said container having a shape of a nonagon.

10. The bottle support plate as defined in claim 1, wherein said anti-rotation wall includes at least one protrusion extended outwardly from a front face of said anti-rotation wall, said at least one protrusion designed to mate with at least a portion of an outer periphery of the flange of said container.

11. The bottle support plate as defined in claim 1, wherein at least a portion of a front face of said anti-rotation wall forms an angle with said support ledge of at least about 90°.

12. The bottle support plate as defined in claim 1, wherein at least a portion of a front face of said anti-rotation wall forms an angle with said support ledge that is greater than 90°.

13. The bottle support plate as defined in claim 1, wherein a top surface of said bottle support plate includes a recessed portion that terminates at said anti-rotation wall.

14. The bottle support plate as defined in claim 13, wherein a front face of said recessed portion includes an arcuate surface.

15. The bottle support plate as defined in claim 1, wherein said bottle support plate is removably connected to said star wheel.

16. The bottle support plate as defined in claim 15, including at least one opening used to connect said bottle support plate to said star wheel.

17. The bottle support plate as defined in claim 3, wherein said support ledge includes a curvilinear shaped front surface, said anti-rotation wall having a front surface that is shaped differently from said front face of said support ledge.

18. The bottle support plate as defined in claim 17, wherein said anti-rotation wall includes a plurality of odd numbered straight surfaces.

19. The bottle support plate as defined in claim 18, wherein said plurality of straight surfaces designed to mate with at least a portion of an outer periphery of the flange of said container having a shape of a heptagon.

20. The bottle support plate as defined in claim 17, wherein said anti-rotation wall includes at least one protrusion extended outwardly from a front face of said anti-rotation wall, said at least one protrusion designed to mate with at least a portion of an outer periphery of the flange of said container.

21. The bottle support plate as defined in claim 19, wherein at least a portion of a front face of said anti-rotation wall forms an angle with said support ledge of at least about 90°.

22. The bottle support plate as defined in claim 20, wherein at least a portion of a front face of said anti-rotation wall forms an angle with said support ledge of at least about 90°.

23. The bottle support plate as defined in claim 21, wherein a top surface of said bottle support plate includes an arcuate shaped recessed portion that terminates at said anti-rotation wall.

24. The bottle support plate as defined in claim 22, wherein a top surface of said bottle support plate includes an arcuate shaped recessed portion that terminates at said anti-rotation wall.

25. The bottle support plate as defined in claim 23, wherein said bottle support plate is removably connected to said star wheel, said bottle support plate including at least one mount opening used to connect said bottle support plate to said star wheel and at least one positioning opening to orient said bottle support plate on said star wheel.

26. The bottle support plate as defined in claim 24, wherein said bottle support plate is removably connected to said star wheel, said bottle support plate including at least one mount opening used to connect said bottle support plate to said star wheel and at least one positioning opening to orient said bottle support plate on said star wheel.

27. A bottle support plate for use in a capping machine used to apply caps onto the upper threaded neck of one or more containers having a non-fully circular flange, said bottle support plate including a pocket that at least partially supports and at least partially mates with the flange of said container to at least partially inhibit rotation of said container during the threading of a cap on said upper threaded neck of said container, said pocket including an anti-rotation wall having a non-fully curvilinear face designed to be at least partially matable with at least a portion of an outer periphery of the flange of said container to at least partially inhibit rotation of said container, said bottle support plate including a support ledge designed to at least partially engage a bottom surface of said flange of said container and to at least partially counter a downward force applied to the upper threaded neck of said container during the threading of a cap on said upper threaded neck of said container.

28. The bottle support plate as defined in claim 27, wherein said anti-rotation wall extends upwardly from said support ledge and forms an angle with said support ledge of at least about 90°.

29. The bottle support plate as defined in claim 27, wherein said anti-rotation wall includes a plurality of odd numbered straight surfaces.

30. The bottle support plate as defined in claim 29, wherein said support ledge includes a front surface and anti-rotation wall having a front surface which is shaped differently from said front face of said support ledge.

31. The bottle support plate as defined in claim 30, wherein said bottle support plate is removably connected to said star wheel, said bottle support plate including at least one mount opening used to connect said bottle support plate to said star wheel and at least one positioning opening to orient said bottle support plate on said star wheel.

32. The bottle support plate as defined in claim 31, wherein a top surface of said bottle support plate includes an arcuate shaped recessed portion that terminates at said anti-rotation wall.

33. An improved rotatable star wheel for a bottling machine for filling and/or capping containers having an upper threaded neck and a non-filly circular flange, said star wheel for moving said containers through said machine, said star wheel comprising at least one bottle support plate that includes a pocket that at least partially supports and at least partially receives and mates with the flange of said container to at least partially inhibit rotation of said container during the threading of a cap on said upper threaded neck of said container, said pocket including an anti-rotation wall having a non-fully curvilinear face designed to be at least partially matable with at least a portion of an outer periphery of the flange of said container to at least partially inhibit rotation of said container, said pocket including a support ledge designed to at least partially engage a bottom surface of said flange of said container and to at least partially counter a downward force applied to the upper threaded neck of said container during the threading of a cap on said upper threaded neck of said container.

34. The improved rotatable star wheel as defined in claim 33, wherein said anti-rotation wall extends upwardly from said support ledge and forms an angle with said support ledge of at least about 90°.

35. The improved rotatable star wheel as defined in claim 34, wherein said anti-rotation wall includes a plurality of odd numbered straight surfaces.

36. The improved rotatable star wheel as defined in claim 35, wherein said support ledge includes a front surface and anti-rotation wall having a front surface which is shaped differently from said front face of said support ledge.

37. The improved rotatable star wheel as defined in claim 36, wherein said bottle support plate is removably connected to said star wheel, said bottle support plate including at least one mount opening used to connect said bottle support plate to said star wheel and at least one positioning opening to orient said bottle support plate on said star wheel.

38. The bottle support plate as defined in claim 37, wherein a top surface of said bottle support plate includes an arcuate shaped recessed portion that terminates at said anti-rotation wall.

39. An improved container guide system for a bottling machine for filling and/or capping containers having an upper threaded neck and a non-fully circular flange, said container guide system retaining said containers in said machine during movement through said machine, said container guide system comprising a rotatable star wheel to move said containers through said machine; at least one bottle support plate that includes a pocket that at least partially supports and at least partially receives and mates with the flange of said container to at least partially inhibit rotation of said container during the threading of a cap on said upper threaded neck of said container, said pocket including an anti-rotation wall having a non-fully curvilinear face designed to be at least partially matable with at least a portion of an outer periphery of the flange of said container to at least partially inhibit rotation of said container; body guide suspended from said star wheel to maintain the sidewall of said containers in position during rotation of said star wheel; and rear guide located radially outwardly from said star wheel to retain said containers within said pocket of said bottle support plate during rotation, said pocket including a support ledge designed to at least partially engage a bottom surface of said flange of said container and to at least partially counter a downward force applied to the upper threaded neck of said container during the threading of a cap on said upper threaded neck of said container.

40. An improved container guide system for a bottling machine for filling and/or capping containers having an upper threaded neck and a non-fully circular flange, said container guide system retaining said containers in said machine during movement through said machine, said container guide system comprising a rotatable star wheel to move said containers through said machine; at least one bottle support plate that includes a pocket that at least partially supports and at least partially receives and mates with the flange of said container to at least partially inhibit rotation of said container during the threading of a cap on said upper threaded neck of said container, said pocket including an anti-rotation wall having a non-fully curvilinear face designed to be at least partially matable with at least a portion of an outer periphery of the flange of said container to at least partially inhibit rotation of said container; body guide suspended from said star wheel to maintain the sidewall of said containers in position during rotation of said star wheel; and rear guide located radially outwardly from said star wheel to retain said containers within said pocket of said bottle support plate during rotation, said anti-rotation wall extending upwardly from said support ledge and forming an angle with said support ledge of at least about 90°.

41. The improved container guide system as defined in claim 40, wherein said anti-rotation wall includes a plurality of odd numbered straight surfaces.

42. The improved container guide system as defined in claim 41, wherein said support ledge includes a front surface and anti-rotation wall having a front surface which is shaped differently from said front face of said support ledge.

43. The improved container guide system as defined in claim 42, wherein said bottle support plate is removably connected to said star wheel, said bottle support plate including at least one mount opening used to connect said bottle support plate to said star wheel and at least one positioning opening to orient said bottle support plate on said star wheel.

44. The improved container guide system as defined in claim 43, wherein a top surface of said bottle support plate includes an arcuate shaped recessed portion that terminates at said anti-rotation wall.

45. A capping machine for applying a threaded cap onto the threaded neck of a container having a generally cylindrical body, and a non-fully circular flange below said threaded neck, said machine including a turret rotatable about a machine axis and carrying a plurality of capping heads, each of which rotate a cap about a capping axis to apply said cap to said neck as said capping head and container move in unison about said machine axis; a capper star wheel rotatable about said machine axis and having a plurality of bottle support plates at least partially engaging said containers immediately below said flanges and lower stabilizers with recesses to engage a container at said body thereof; and, a fixed guide plate with an arcuate guide surface concentric with said machine axis and radially spaced from said star wheel at a position generally diametrically opposite to said bottle support plates of said star wheel whereby containers carried by said star wheel are capped as they are moved along said guide surface of said fixed guide plate, the improvement comprising: each of said bottle support plates including a pocket that at least partially supports and at least partially receives and mates with said flange of said container to at least partially inhibit rotation of said container during the threading of said cap on said neck of said container, said pocket including an anti-rotation wall having a non-fully curvilinear face designed to be at least partially matable with at least a portion of an outer periphery of the flange of said container to at least partially inhibit rotation of said container, said pocket including a support ledge designed to at least partially engage a bottom surface of said flange of said container and to at least partially counter a downward force applied to the upper threaded neck of said container during the threading of a cap on said upper threaded neck of said container.

46. The capping machine as defined in claim 45, wherein said anti-rotation wall extends upwardly from said support ledge and forms an angle with said support ledge of at least about 90°.

47. The capping machine as defined in claim 46, wherein said anti-rotation wall includes a plurality of odd numbered straight surfaces.

48. The capping machine as defined in claim 47, wherein said support ledge includes a front surface and anti-rotation wall having a front surface which is shaped differently from said front face of said support ledge.

49. The capping machine as defined in claim 48, wherein said bottle support plate is removably connected to said star wheel, said bottle support plate including at least one mount opening used to connect said bottle support plate to said star wheel and at least one positioning opening to orient said bottle support plate on said star wheel.

50. The capping machine as defined in claim 49, wherein a top surface of said bottle support plate includes an arcuate shaped recessed portion that terminates at said anti-rotation wall.

* * * * *